US011756759B2

(12) United States Patent
Mori et al.

(10) Patent No.: US 11,756,759 B2
(45) Date of Patent: Sep. 12, 2023

(54) ELECTROMAGNETIC RELAY WITH MODIFICATION OF DRIVE SHAFT OR MOVABLE IRON CORE

(71) Applicant: OMRON Corporation, Kyoto (JP)

(72) Inventors: Shingo Mori, Yamaga (JP); Ryota Minowa, Yamaga (JP); Yasuo Hayashida, Kumamoto (JP); Naoki Kawaguchi, Yame (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/262,221

(22) PCT Filed: Feb. 19, 2019

(86) PCT No.: PCT/JP2019/006140

§ 371 (c)(1),
(2) Date: Jan. 22, 2021

(87) PCT Pub. No.: WO2020/039615

PCT Pub. Date: Feb. 27, 2020

(65) Prior Publication Data

US 2021/0327671 A1 Oct. 21, 2021

(30) Foreign Application Priority Data

Aug. 24, 2018 (JP) ..... 2018-157759

(51) Int. Cl.
*H01H 50/64* (2006.01)
*H01H 50/60* (2006.01)

(52) U.S. Cl.
CPC ..... *H01H 50/64* (2013.01); *H01H 50/60* (2013.01)

(58) Field of Classification Search
CPC ..... H01H 50/64; H01H 50/60
See application file for complete search history.

(56) References Cited

U.S. PATENT DOCUMENTS 7,626,288 B2 * 12/2009 Protze ..... H01F 7/1607 335/279
8,749,331 B2 * 6/2014 Kashimura ..... H01H 33/182 335/201

(Continued)

FOREIGN PATENT DOCUMENTS

JP 2006-310250 A 11/2006
JP 2012-089491 A 5/2012

(Continued)

OTHER PUBLICATIONS

The International Search Report of International Application No. PCT/JP2019/006140 dated May 28, 2019.

(Continued)

*Primary Examiner* — Bernard Rojas
(74) *Attorney, Agent, or Firm* — SHINJYU GLOBAL IP

(57) ABSTRACT

An electromagnetic relay includes a fixed contact, a movable contact piece having a movable contact, a drive shaft, an electromagnetic drive device, and a positioning portion. The movable contact piece is movable in a first direction contacting the fixed contact and in a second direction separating from the fixed contact. The electromagnetic drive device includes a movable iron core integrally movably connected to the drive shaft. The electromagnetic drive device switches between a contact state in which the movable contact comes into contact with the fixed contact and a separate state in which the movable contact is separated from the fixed contact by moving the drive shaft with the movable iron core. The positioning portion positions the drive shaft or the movable iron core in the separate state. The drive shaft or the (Continued)

movable iron core includes a first inclined portion that contacts the positioning portion in the separate state.

13 Claims, 5 Drawing Sheets

(56) References Cited

U.S. PATENT DOCUMENTS

| | | | | |
|---|---|---|---|---|
| 2007/0241847 | A1 | 10/2007 | Yamamoto et al. | |
| 2012/0092098 | A1* | 4/2012 | Choi | H01H 51/065 335/189 |
| 2013/0228552 | A1 | 9/2013 | Kashimura et al. | |
| 2015/0054605 | A1* | 2/2015 | Kubono | H01H 50/18 335/177 |
| 2016/0181038 | A1* | 6/2016 | Shimizu | H01H 50/54 335/165 |
| 2016/0300676 | A1 | 10/2016 | Sakai et al. | |
| 2018/0223783 | A1* | 8/2018 | Bohmann | F16K 31/0689 |

FOREIGN PATENT DOCUMENTS

| | | | |
|---|---|---|---|
| JP | 5684650 | B2 | 3/2015 |
| JP | 2016-201286 | A | 12/2016 |

OTHER PUBLICATIONS

The Written Opinion of the International Searching Authority of International Application No. PCT/JP2019/006140 dated May 28, 2019.

* cited by examiner

ELECTROMAGNETIC RELAY WITH MODIFICATION OF DRIVE SHAFT OR MOVABLE IRON CORE

CROSS-REFERENCE TO RELATED APPLICATION

This application is the U.S. National Phase of International Application No. PCT/JP2019/006140, filed on Feb. 19, 2019. This application claims priority to Japanese Patent Application No. 2018-157759, filed Aug. 24, 2018. The contents of that application are incorporated by reference herein in their entireties.

FIELD

The present invention relates to an electromagnetic relay.

BACKGROUND

Conventionally, electromagnetic relays that open and close an electric circuit are known. The electromagnetic relay includes a fixed contact, a movable contact, a drive shaft, and an electromagnetic drive device. The electromagnetic drive includes a coil, a movable iron core connected to the drive shaft, and an urging member. The movable iron core is movable between an operating position and a cutoff position, and is urged toward the cutoff position by the urging member.

When a voltage is applied to the coil, the movable iron core moves from the cutoff position to the operating position against the elastic force of the urging member. As a result, the movable contact contacts the fixed contact via the drive shaft. When the application of the voltage to the coil is stopped, the movable iron core moves from the operating position to the cutoff position due to the elastic force of the urging member. As a result, the movable contact is separated from the fixed contact via the drive shaft.

SUMMARY

For example, in Japanese Patent No. 5684650, the movable iron core comes into contact with an auxiliary yoke and is positioned at the cutoff position. Therefore, the movable iron core collides with the auxiliary yoke when moving from the operating position to the cutoff position. Since a portion where the movable iron core and the auxiliary yoke come into contact with each other is formed by a flat surface orthogonal to the drive shaft, a large impact force is generated in the axial direction when the movable shaft collides with the auxiliary yoke. If this impact force exceeds the elastic force of the urging member, the movable iron core may move to the operating position, causing a malfunction such as the movable contact contacting the fixed contact.

Further, Japanese Patent No. 5684650 discloses a configuration in which a magnet is disposed around the movable iron core to absorb vibration and impact of the movable iron core by an attractive force of the magnet. In this case, the manufacturing cost increases due to the increase in the number of parts. Similarly, Japanese Laid-Open Patent Application No. 2016-201286 discloses a configuration in which vibration and impact of the movable iron core are absorbed by a cushion rubber. In this case as well, the manufacturing cost increases due to the increase in the number of parts.

An object of the present invention is to improve a cutoff performance between the fixed contact and the movable contact. Another object of the present invention is to improve the cutoff performance between the fixed contact and the movable contact while reducing an increase in manufacturing cost.

(1) An electromagnetic relay according to one aspect of the present invention includes a fixed contact, a movable contact piece, a drive shaft, an electromagnetic drive device, and a positioning portion. The movable contact piece includes a movable contact disposed to face the fixed contact, and is movable in a first direction in contact with the fixed contact and in a second direction separating from the fixed contact. The drive shaft is connected to the movable contact piece and movable in the first direction and second direction together with the movable contact piece. The electromagnetic drive device includes a movable iron core that is integrally movably connected to the drive shaft, and switches between a contact state in which the movable contact comes into contact with the fixed contact and a separate state in which the movable contact is separated from the fixed contact by moving the drive shaft with the movable iron core. The positioning portion positions one of the drive shaft or the movable iron core in the separate state. One of the drive shaft or the movable iron core includes a first inclined portion that comes into contact with the positioning portion in the separate state.

In this electromagnetic relay, one of the drive shaft or the movable iron core includes the first inclined portion that comes into contact with the positioning portion in the separate state. For example, when the movable iron core includes the first inclined portion, when the movable contact is switched from the contact state to the separate state, the movable iron core moves in the second direction and the first inclined portion of the movable iron core collides with the positioning portion. Therefore, for example, the impact force generated in the axial direction can be reduced as compared with the case where the positioning portion and the first inclined portion collide with each other in planes perpendicular to the drive shaft. Therefore, in such case where the movable iron core collides with the positioning portion, the occurrence of malfunction such as the movable iron core moving in the first direction and the movable contact coming into contact with the fixed contact can be reduced. That is, it is possible to improve a cutoff performance between the fixed contact and the movable contact.

(2) Preferably, the first inclined portion is inclined in the first direction side or the second direction side toward the axis of the drive shaft. In this case, the first inclined portion can be realized with a simple configuration.

(3) Preferably, the first inclined portion includes a curved surface portion formed in a curved surface shape. Even in this case, the impact force generated in the axial direction can be reduced as compared with the case where the positioning portion and the first inclined portion collide with each other in planes perpendicular to the drive shaft.

(4) Preferably, the positioning portion includes a second inclined portion that comes into contact with the first inclined portion. The first inclined portion and the second inclined portion are inclined in the first direction side or the second direction side toward the axis of the drive shaft. In this case, since the second inclined portion of the positioning portion comes into contact with the first inclined portion, the impact force generated in the axial direction can be reduced as compared with the case where the positioning portion and the first inclined portion collide with each other in planes perpendicular to the drive shaft.

(5) Preferably, the electromagnetic relay further includes a contact case housing the fixed contact and movable contact. The contact case includes a tubular portion disposed to face the movable iron core. The positioning portion is formed on the tubular portion. The movable iron core includes the first inclined portion. In this case, since the positioning portion can be integrally formed with the contact case, the manufacturing cost can be reduced.

(6) Preferably, the electromagnetic drive device includes a bottomed tubular housing member that houses the movable iron core. The movable iron core includes the first inclined portion and is disposed to face a bottom portion of the housing member. The positioning portion is formed on the bottom of the housing member. In this case, since the positioning portion can be integrally formed with the housing member, the manufacturing cost can be reduced.

(7) Preferably, the electromagnetic relay further includes a contact case housing the fixed contact and movable contact. The drive shaft includes a first inclined portion. The contact case includes a tubular portion disposed to face the first inclined portion. The positioning portion is formed on the tubular portion. In this case, since the positioning portion can be integrally formed with the contact case, the manufacturing cost can be reduced.

(8) Preferably, the electromagnetic relay further includes a cover portion disposed to the second direction side with respect to the drive shaft. The positioning portion is disposed on the cover portion to face one end of the drive shaft. The drive shaft includes a first inclined portion. In this case, since the positioning portion can be integrally formed with the cover portion, the manufacturing cost can be reduced.

DETAILED DESCRIPTION

Figure 1:
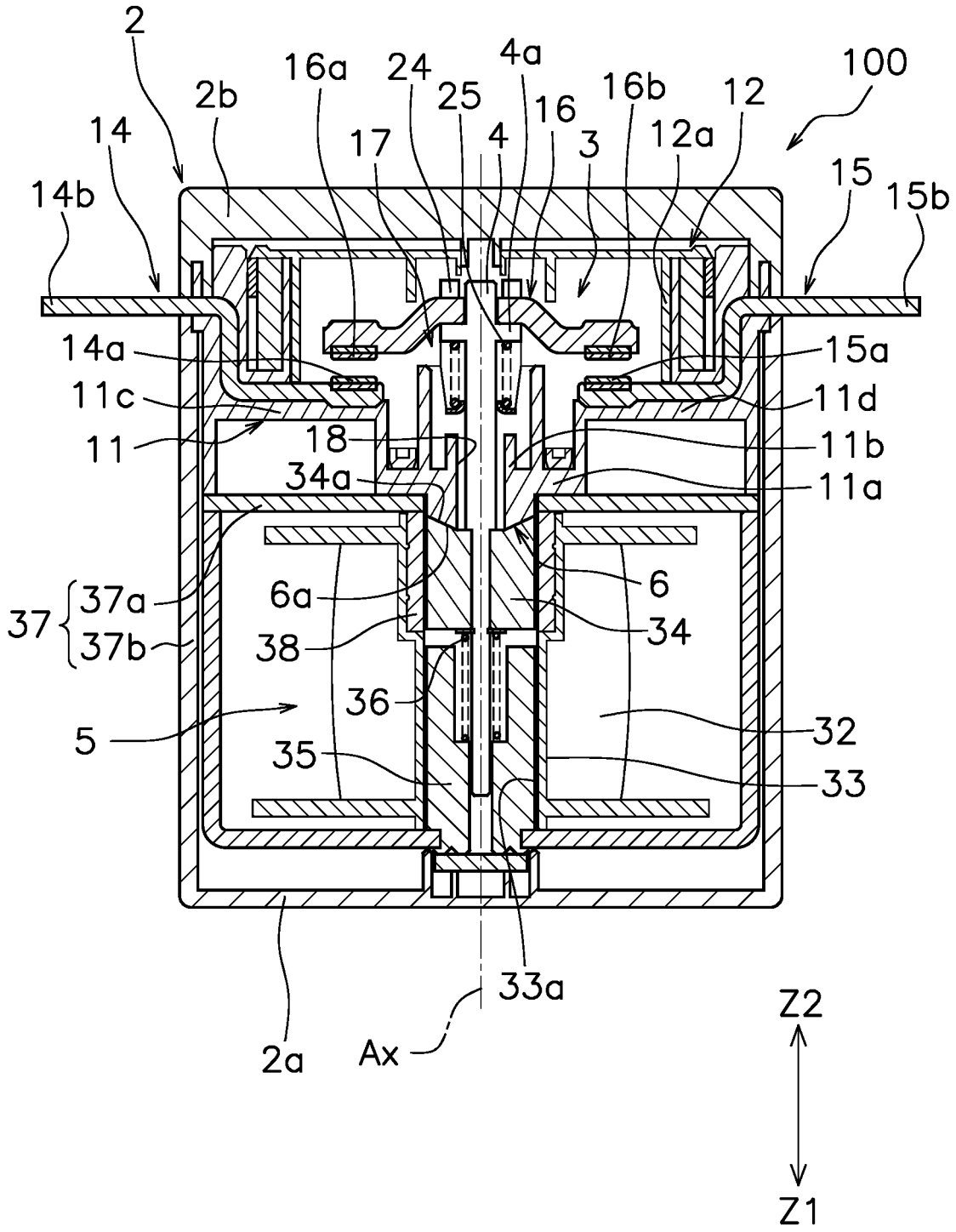
FIG. 1 is a cross-sectional view of an electromagnetic relay according to an embodiment of the present invention.

Hereinafter, embodiments of an electromagnetic relay according to one aspect of the present invention will be described with reference to the drawings. FIG. 1 is a cross-sectional view of the electromagnetic relay 100. As illustrated in FIG. 1, the electromagnetic relay 100 includes a housing 2, a contact device 3, a drive shaft 4, an electromagnetic drive device 5, and a positioning portion 6.

In the following description, the direction in which an axis Ax of the drive shaft 4 extends is referred to as "axial direction". Further, when referring to the drawings, an upper side in FIG. 1 is be referred to as "up", a lower side is referred to as "down", a left side is referred to as "left", and a right side is referred to as "right" in order to facilitate understanding of the description. In this embodiment, a contact direction Z1 is downward in FIG. 1. Further, a separation direction Z2 is upward in FIG. 1. The details of the contact direction Z1 and the separation direction Z2 will be described later.

The housing 2 includes a case 2*a* and a cover 2*b*. The case 2*a* has a substantially quadrangular box shape, and an upper part is separate. The cover 2*b* covers the upper part of the case 2*a*. The case 2*a* and the cover 2*b* are made of an insulating material. The contact device 3, the drive shaft 4, and the electromagnetic drive device 5 are housed inside the housing 2.

In the housing 2, a contact case 11 in which the contact device 3 is housed and a contact cover 12 that covers an upper part of the contact case 11 are disposed. The contact case 11 and the contact cover 12 are made of an insulating material.

The contact case 11 includes a bottom portion 11*a*, a tubular portion 11*b*, a first contact support portion 11*c*, and a second contact support portion 11*d*. The bottom portion 11*a* is formed in a rectangular shape and a plate shape. The longitudinal direction of the bottom portion 11*a* coincides with the left-right direction in FIG. 1.

The tubular portion 11*b* extends in a cylindrical shape in the axial direction. The tubular portion 11*b* protrudes downward from the center of the bottom portion 11*a* and protrudes upward from the center of the bottom portion 11*a*. The tubular portion 11*b* includes a through hole 18 that axially penetrates the bottom portion 11*a*. The through hole 18 penetrates the center of the bottom portion 11*a* in the axial direction. The drive shaft 4 penetrates the through hole 18 in the axial direction. The tubular portion 11*b* does not necessarily need to be cylindrical.

The first contact support portion 11*c* is disposed to the left side with respect to the center of the bottom portion 11*a* in the longitudinal direction. The first contact support portion 11*c* is formed so as to protrude upward in a rectangular shape from the bottom portion 11*a*. The second contact support portion 11*d* is disposed to the right side with respect to the center of the bottom portion 11*a* in the longitudinal direction. The second contact support portion 11*d* is formed so as to protrude upward in a rectangular shape from the bottom portion 11*a*.

The contact cover 12 covers the upper part of the contact case 11. The contact cover 12 includes an arc extension wall 12*a* extending toward the bottom portion 11*a*. The arc extension wall 12*a* is made of, for example, a resin or a ceramic material such as aluminum oxide.

The contact device 3 includes a first fixed terminal 14, a second fixed terminal 15, a movable contact piece 16, and a contact piece holding portion 17. The first fixed terminal 14, the second fixed terminal 15, and the movable contact piece 16 are made of a conductive material.

The first fixed terminal 14 extends in the left-right direction and is supported in the housing 2 by the first contact support portion 11*c* of the contact case 11. The first fixed terminal 14 includes a first fixed contact 14*a* and a first external connection portion 14*b*. The first fixed contact 14*a* is disposed at an upper part of the first contact support portion 11*c* in the contact case 11. The first fixed contact 14*a* is an example of a fixed contact. The first external connection portion 14*b* protrudes from the case 2*a* in the left-right direction.

The second fixed terminal 15 extends in the left-right direction and is supported by the second contact support portion 11*d* of the contact case 11 in the housing 2. The second fixed terminal 15 includes a second fixed contact 15*a* and a second external connection portion 15*b*. As illustrated in FIG. 1, since the second fixed terminal 15 has a symmetrical shape with the first fixed terminal 14 with the axis Ax of the drive shaft 4 interposed therebetween, the description thereof will be omitted. The second fixed contact 15*a* is an example of a fixed contact.

The movable contact piece 16 extends in the left-right direction in the contact case 11. The movable contact piece 16 is disposed to face the first fixed terminal 14 and the second fixed terminal 15. The movable contact piece 16 is disposed above the first fixed contact 14*a* and the second fixed contact 15*a*. The movable contact piece 16 includes a first movable contact 16*a* and a second movable contact 16*b*. The first movable contact 16*a* is disposed to face the first fixed contact 14*a* and is contactable with the first fixed contact 14*a*. The second movable contact 16*b* is disposed to face the second fixed contact 15*a* and is contactable with the second fixed contact 15*a*. The first movable contact 16*a* and the second movable contact 16*b* are examples of movable contacts.

The movable contact piece 16 is movable in the contact direction Z1 in contact with the first fixed contact 14*a* and the second fixed contact 15*a*, and the separation direction Z2 separating from the first fixed contact 14*a* and the second fixed contact 15*a*.

The contact direction Z1 is the direction in which the first movable contact 16*a* and the second movable contact 16*b* come into contact with the first fixed contact 14*a* and the second fixed contact 15*a* (downward in FIG. 1). The separation direction Z2 is the direction in which the first movable contact 16*a* and the second movable contact 16*b* are separated from the first fixed contact 14*a* and the second fixed contact 15*a* (upward in FIG. 1). The contact direction Z1 and the separation direction Z2 coincide with the axial direction.

The contact piece holding portion 17 holds the movable contact piece 16 via the drive shaft 4. The contact piece holding portion 17 connects the movable contact piece 16 and the drive shaft 4. The contact piece holding portion 17 includes a holder 24 and a contact spring 25. The movable contact piece 16 is sandwiched between an upper portion of the holder 24 and a flange portion 4*a* of the drive shaft 4 in the axial direction. The contact spring 25 is disposed between a bottom of the holder 24 and the flange portion 4*a* of the drive shaft 4, and urges the drive shaft 4 and the movable contact piece 16 toward the separation direction Z2.

The drive shaft 4 extends along the contact direction Z1 and the separation direction Z2. The drive shaft 4 is connected to the movable contact piece 16 via the contact piece holding portion 17. The drive shaft 4 movable together with the movable contact piece 16 in the contact direction Z1 and the separation direction Z2.

The electromagnetic drive device 5 moves the drive shaft 4 in the contact direction Z1 and the separation direction Z2. As a result, the electromagnetic drive device 5 switches between a contact state in which the first movable contact 16*a* and the second movable contact 16*b* contact the first fixed contact 14*a* and the second fixed contact 15*a* (see FIG. 2) and a separate state in which the first movable contact 16*a* and the second movable contact 16*b* are separated from the first fixed contact 14*a* and the second fixed contact 15*a* (see FIG. 1). The electromagnetic drive device 5 is disposed below the contact case 11 in the housing 2.

The electromagnetic drive device 5 includes a coil 32, a spool 33, a movable iron core 34, a fixed iron core 35, an urging member 36, and a yoke 37.

The coil 32 is mounted on an outer circumference of the spool 33. The spool 33 includes a housing portion 33*a*. The housing portion 33*a* is provided on an inner peripheral portion of the spool 33. The housing portion 33*a* has a cylindrical shape and extends along the axial direction.

The movable iron core 34 is disposed in the housing portion 33*a*. The movable iron core 34 is disposed to face the tubular portion 11*b* of the contact case 11. The movable iron core 34 is, for example, cylindrical, and the drive shaft 4 penetrates the center in the axial direction and is integrally movably connected to the drive shaft 4. The movable iron core 34 is movable in the axial direction together with the drive shaft 4 between a cutoff position illustrated in FIG. 1 and an operating position illustrated in FIG. 2. The movable iron core 34 is located at the cutoff position when in the separate state, and is located at the operating position when in the contact state.

The movable iron core 34 includes a first inclined portion 34*a*. The first inclined portion 34*a* is formed on the surface of the movable iron core 34 in the separation direction Z2 side. The first inclined portion 34*a* is disposed to face the positioning portion 6 and is contactable with the positioning portion 6. The first inclined portion 34*a* inclines in the contact direction Z1 side toward the axis Ax of the drive shaft 4.

The fixed iron core 35 is disposed in the housing portion 33*a* to face the movable iron core 34 on the contact direction Z1 side with respect to the movable iron core 34. The fixed iron core 35 is fixed to the yoke 37.

The urging member 36 is, for example, a coil spring, and is disposed between the movable iron core 34 and the fixed iron core 35. The urging member 36 urges the movable iron core 34 toward the separation direction Z2. Therefore, the urging member 36 is disposed between the movable iron core 34 and the fixed iron core 35 in a compressed state.

The yoke 37 includes a first yoke 37*a* and a second yoke 37*b*. The first yoke 37*a* has a plate shape and is disposed between the bottom portion 11*a* of the contact case 11 and the spool 33. The first yoke 37*a* overlaps a lower portion of the tubular portion 11*b* in the left-right direction. The first yoke 37*a* is connected to the fixed iron core 35. The second yoke 37*b* has a substantially U shape, and the bottom portion is disposed below the spool 33. The upper ends of both sides of the second yoke 37*b* are connected to the first yoke 37*a*.

The positioning portion 6 is disposed at the end portion of the contact case 11 in the contact direction Z1 side of the tubular portion 11*b*. In the present embodiment, the positioning portion 6 positions the movable iron core 34 in the separate state. Specifically, as illustrated in FIG. 1, the positioning portion 6 contacts the movable iron core 34 in the open state to position the movable iron core 34 at the cutoff position. That is, the positioning portion 6 prohibits the movable iron core 34 from moving toward the separation direction Z2 in the separate state.

Figure 2:
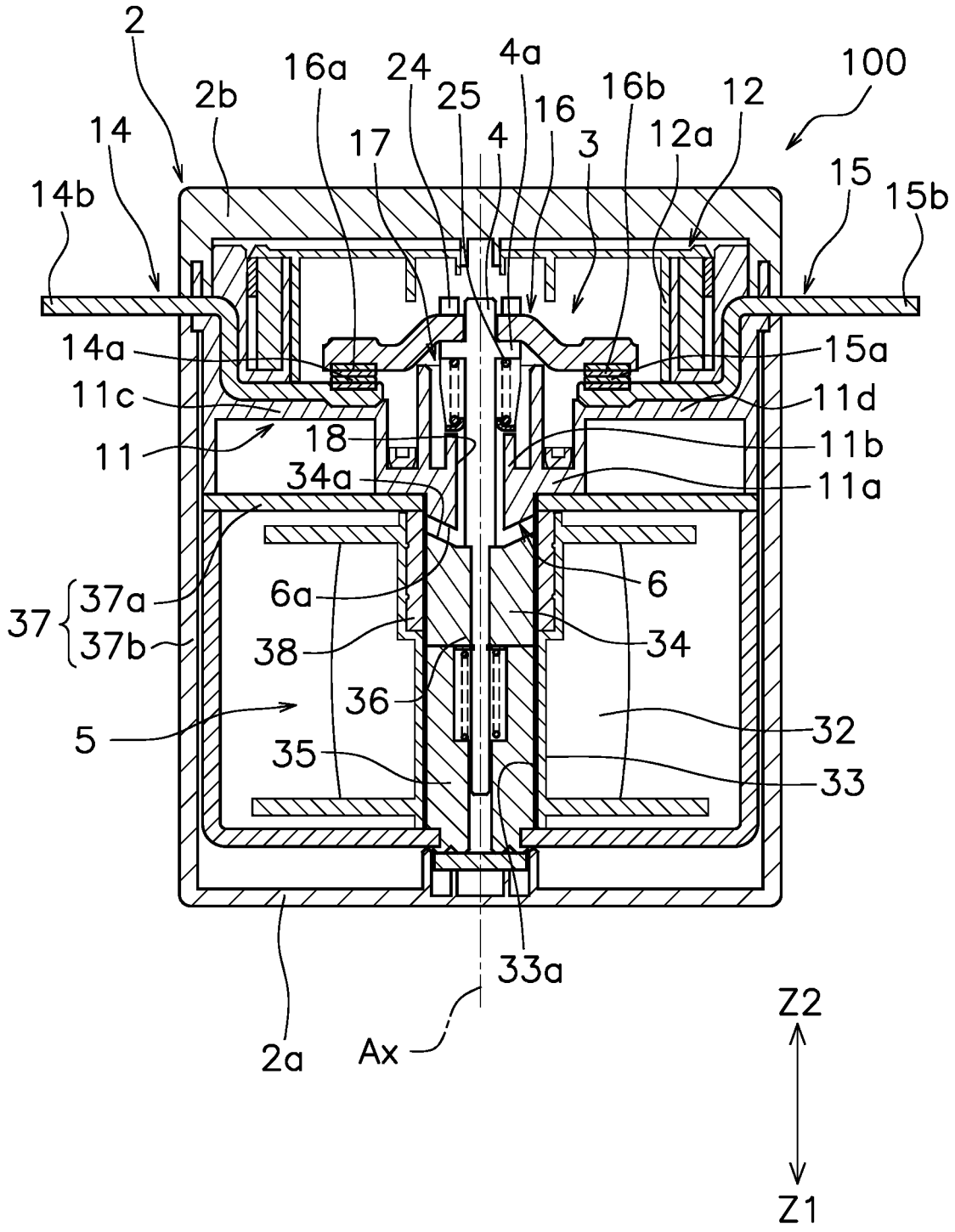
FIG. 2 is a cross-sectional view of an electromagnetic relay when a voltage is applied to a coil.

The positioning portion 6 includes a second inclined portion 6*a*. The second inclined portion 6*a* is formed on the surface of the tubular portion 11*b* of the contact case 11 in the contact direction Z1 side. Second inclined section 6*a* has a shape corresponding to the first inclined portion 34*a* of the movable iron core 34. Specifically, the second inclined portion 6*a* inclines in the contact direction Z1 side toward the axis Ax of the drive shaft 4. That is, the second inclined portion 6*a* has a tapered shape that tapers toward the axis Ax of the drive shaft 4. The second inclined portion 6*a* comes into contact with the first inclined portion 34*a* of the movable iron core 34 in the separate state. As a result, the movable iron core 34 is positioned at the cutoff position. As illustrated in FIG. 2, the positioning portion 6 is in a state of being separated from the movable iron core 34 when the movable iron core 34 is in the operating position.

Next, the operation of the electromagnetic relay 100 will be described. FIG. 1 shows a state in which no voltage is applied to the coil 32. When no voltage is applied to the coil 32, the urging member 36 prevents the movable iron core 34 from moving in the separation direction Z2, so that the movable iron core 34 is in the cutoff position. Therefore, the first movable contact 16*a* and the second movable contact 16*b* are in a state of being separated from the first fixed contact 14*a* and the second fixed contact 15*a*.

FIG. 2 shows a state in which a voltage is applied to the coil 32. When the voltage is applied to the coil 32 to excite it, the movable iron core 34 moves from the cutoff position to the operating position against the elastic force of the urging member 36 due to the electromagnetic force of the coil 32. As the movable iron core 34 moves to the operating position, the drive shaft 4 and the movable contact piece 16 move in the contact direction Z1, and the first movable contact 16*a* and the second movable contact 16*b* contact the first fixed contact 14*a* and the second fixed contact 15*a*.

When the application of the voltage to the coil 32 is stopped, the movable iron core 34 moves from the operating position to the cutoff position by the elastic force of the urging member 36, and the first movable contact 16*a* and the second movable contact 16*b* separate from the first fixed contact 14*a* and the second fixed contact 15*a*. When the movable iron core 34 moves from the operating position to the cutoff position, the movable iron core 34 collides with the positioning portion 6 and an impact force is generated in the axial direction. If this collision force exceeds the elasticity of the urging member 36, the movable iron core 34 may move to the operating position, and the first movable contact 16*a* and the second movable contact 16*b* may contact the first fixed contact 14*a* and the second fixed contact 15*a*.

In the present embodiment, when the application of the voltage to the coil 32 is stopped and the movable iron core 34 moves from the operating position to the cutoff position, the first inclined portion 34*a* of the movable iron core 34 and the second inclined portion 6*a* of the positioning portion 6 collides with each other. As a result, the impact force generated in the axial direction according to the inclination angles of the first inclined portion 34*a* and the second inclined portion 6*a* is distributed as vectors, so that the impact force generated in the axial direction can be reduced as compared with the case where the movable iron core 34 and the positioning portion 6 collide with each other in planes perpendicular to the drive shaft 4.

Therefore, in such case where the movable iron core 34 collides with the positioning portion 6, the occurrence of malfunction such as the movable iron core 34 moving to the operating position and the first movable contact 16*a* and the second movable contact 16*b* coming into contact with the first fixed contact 14*a* and the second fixed contact 15*a* can be reduced. As a result, it is possible to improve the cutoff performance between the contacts at the first fixed contact 14*a* and the first movable contact 16*a*, and at the second fixed contact 15*a* and the second movable contact 16*b*. Further, since the impact of the movable iron core 34 can be reduced without the use of magnets, cushion rubber, or other components, the manufacturing cost can also be reduced.

Although the embodiment of the electromagnetic relay according to one aspect of the present invention has been described above, the present invention is not limited to the above embodiment, and various modifications can be made without departing from the gist of the invention. For example, the configuration of the electromagnetic drive device 5 may be changed. The shape or arrangement of the coil 32, the spool 33, the movable iron core 34, the urging member 36, or the yoke 37 may be changed. The shape or arrangement of the housing 2, the contact device 3, the contact case 11, and the contact cover 12 may be changed.

In particular, the shapes of the positioning portion 6 and the first inclined portion 34*a* of the movable iron core 34 are not limited to the above-described embodiment. The shape of the first inclined portion 34*a* of the positioning portion 6 and the movable iron core 34 may be any shape that can reduce the impact force generated in the axial direction when the positioning portion 6 and the first inclined portion 34*a* collide with each other.

Figure 3:
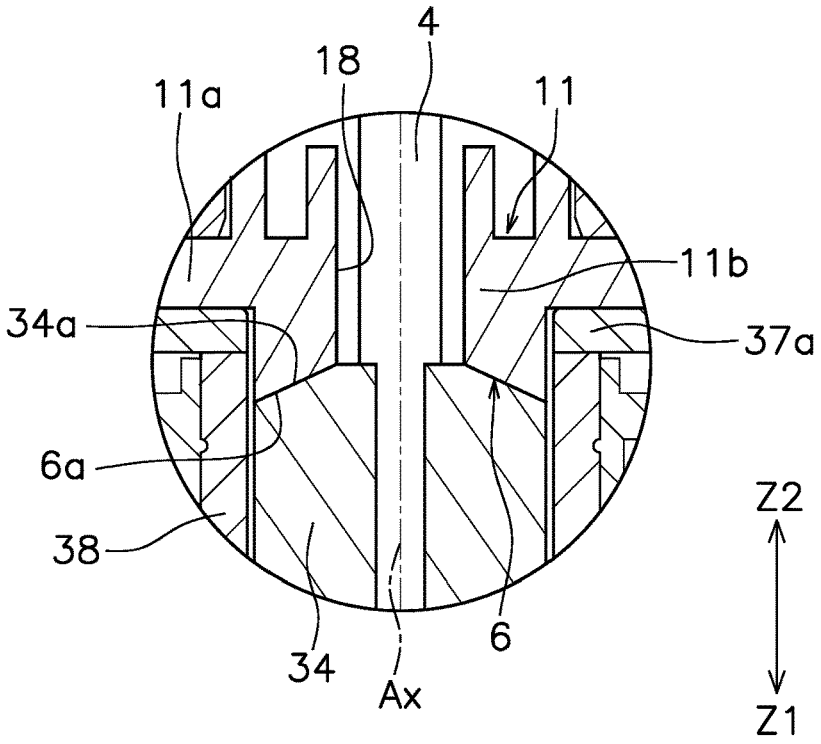
FIG. 3 is an enlarged cross-sectional view around a movable iron core according to a first modification.
Figure 4:
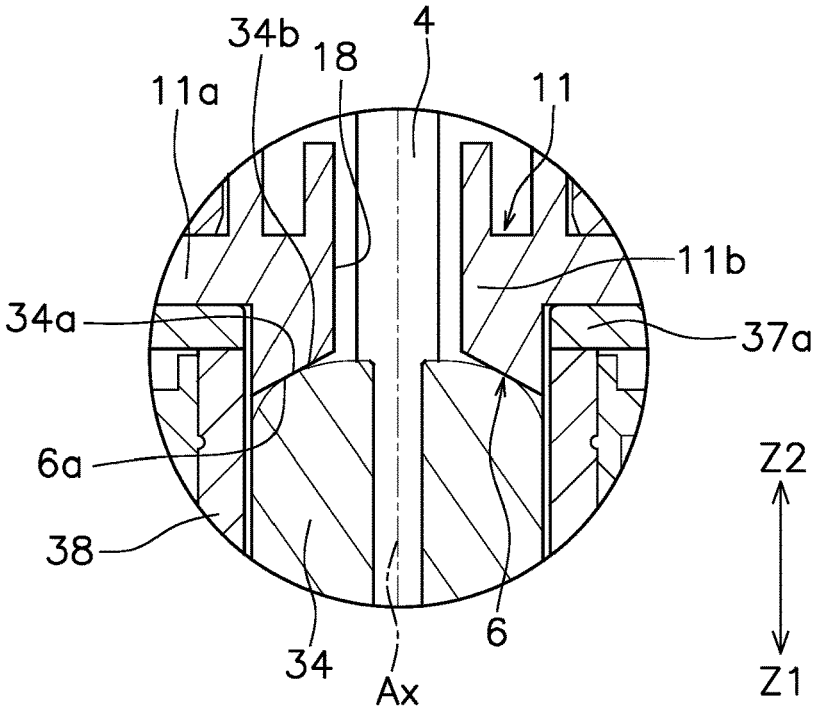
FIG. 4 is an enlarged cross-sectional view around a movable iron core according to a first modification.

FIG. 3 is an enlarged cross-sectional view of a periphery of the movable iron core 34 according to a first modification. FIG. 3 shows a state when the movable iron core 34 is located at the cutoff position. In the first modification, the shapes of the first inclined portion 34*a* of the movable iron core 34 and the second inclined portion 6*a* of the positioning portion 6 are interchanged with each other. The first inclined portion 34*a* of the movable iron core 34 is inclined the separation direction Z2 side toward the axis Ax of the drive shaft 4. That is, the first inclined portion 34*a* of the movable iron core 34 has a tapered shape that tapers toward the axis Ax of the drive shaft 4. The second inclined portion 6*a* of the positioning portion 6 inclines in the separation direction Z2 side toward the axis Ax of the drive shaft 4. As illustrated in FIG. 4, the first inclined portion 34*a* may include a curved surface portion 34*b* formed in a curved surface shape. Similarly, the second inclined portion may be formed in a curved surface shape.

Figure 5:
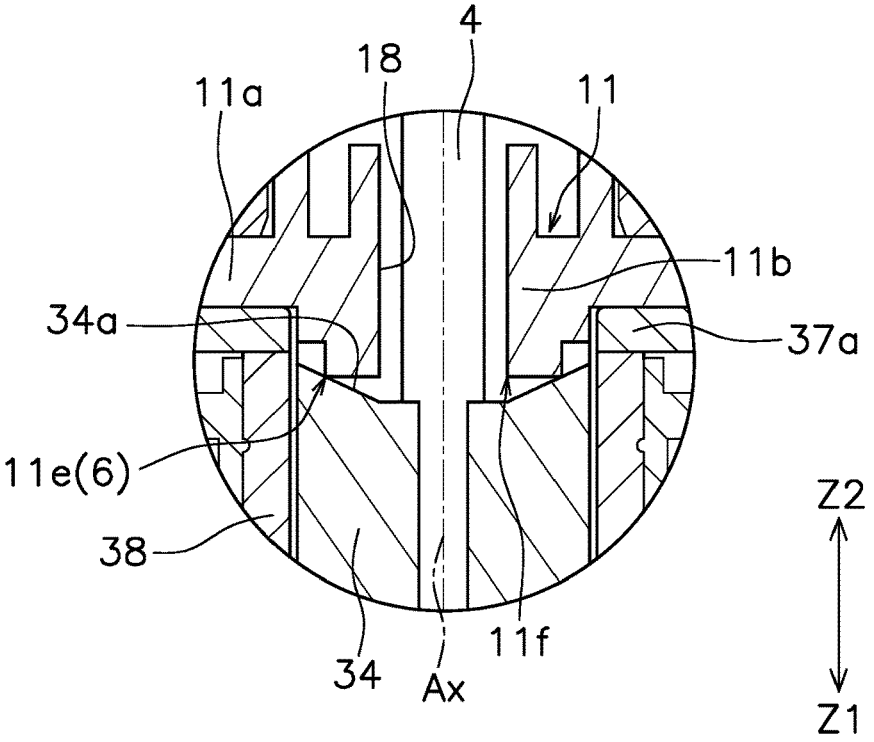
FIG. 5 is an enlarged cross-sectional view around a movable iron core according to a second modification.

FIG. 5 is an enlarged cross-sectional view of a periphery of the movable iron core 34 according to a second modification. FIG. 5 shows a state when the movable iron core 34 is located at the cutoff position. The first inclined portion 34*a* of the movable iron core 34 has the same shape as that of the above-described embodiment. A surface of the tubular portion 11*b* on the contact direction Z1 side has a flat shape along the direction orthogonal to the drive shaft 4. The positioning portion 6 is an outer end portion 11*e* of the surface of the tubular portion 11*b* on the contact direction Z1 side. Therefore, the movable iron core 34 is positioned with the first inclined portion 34*a* of the movable iron core 34 in line contact with the outer end portion 11*e*. The first inclined portion 34*a* of the movable iron core 34 may have a tapered shape that tapers toward the axis Ax of the drive shaft 4, as in the first modification. In this case, the first inclined portion 34*a* of the movable iron core 34 is positioned by line contact with the inner end portion 11*f* (see FIG. 5) of the tubular portion 11*b*.

Figure 6:
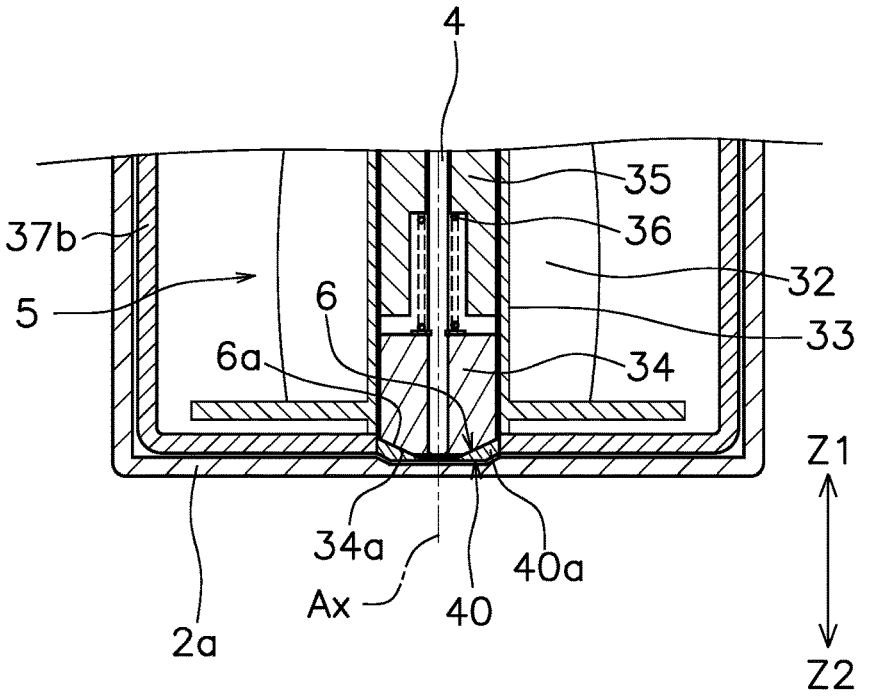
FIG. 6 is an enlarged cross-sectional view around a movable iron core according to a third modification.

FIG. 6 is an enlarged cross-sectional view of a periphery of the movable iron core 34 according to a third modification. FIG. 6 shows a state when the movable iron core 34 is located at the cutoff position. In the third modification, the contact direction Z1 and the separation direction Z2 are opposite to those of the above embodiment. Further, the movable iron core 34, the fixed iron core 35, and the urging member 36 are housed in a bottomed tubular housing member 40 disposed on the inner peripheral portion of the spool 33. The movable iron core 34 is disposed to face the fixed iron core 35 on the separation direction Z2 side with respect to the fixed iron core 35. The movable iron core 34 is urged to the separation direction Z2 side by the urging member 36. In this embodiment, the movable iron core 34 is urged downward.

The positioning portion 6 is formed on the bottom portion 40*a* of the housing member 40. The positioning portion 6 includes a second inclined portion 6*a*. The second inclined portion 6*a* is formed on the bottom surface on the contact direction Z1 side. The second inclined portion 6*a* is formed to be inclined in the separation direction Z2 side toward the axis Ax of the drive shaft 4.

The first inclined portion 34*a* of the movable iron core 34 is formed on the surface in the separation direction Z2 side, as in the above embodiment. The first inclined portion 34*a* is disposed to face the positioning portion 6 and is contactable with the positioning portion 6. The first inclined portion 34*a* has a shape corresponding to the second inclined portion 6*a* of the positioning portion 6. The first inclined portion 34*a* is formed to be inclined in the separation direction Z2 side toward the axis Ax of the drive shaft 4. In the third modification, the same effect as that of the above embodiment can be obtained.

Figure 7:
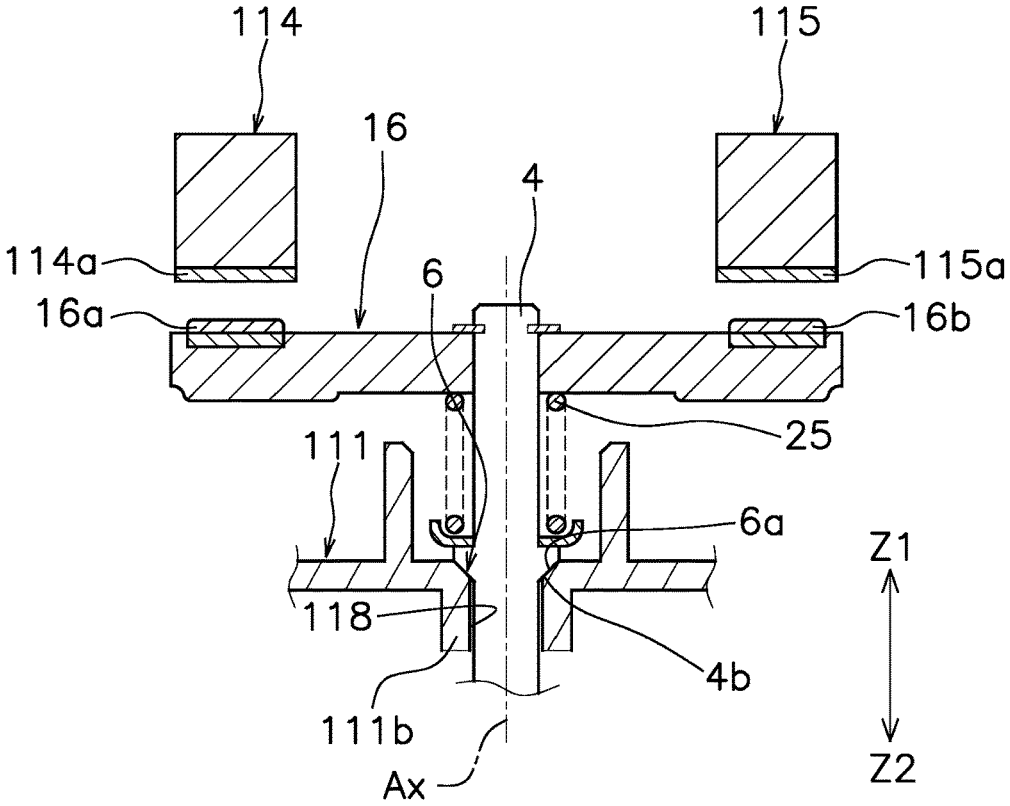
FIG. 7 is an enlarged cross-sectional view of a periphery of a tubular portion of a contact case according to a fourth modification.

FIG. 7 is an enlarged cross-sectional view of a periphery of a tubular portion 111*b* of a contact case 111 according to a fourth modification. In the fourth modification, a first fixed terminal 114 and a second fixed terminal 115 are composed of substantially cylindrical terminals extending in the axial direction. The first fixed terminal 114 and the second fixed terminal 115 are mounted on, for example, a housing (not illustrated). The first fixed terminal 114 includes a first fixed contact 114*a*. The second fixed terminal 115 includes a second fixed contact 115*a*.

The drive shaft 4 includes a first inclined portion 4*b* that comes into contact with the positioning portion 6. The first inclined portion 4*b* inclines in the separation direction Z2 side toward the axis Ax of the drive shaft 4. The first inclined portion 4*b* is disposed to face the tubular portion 111*b* of the contact case 111.

The positioning portion 6 positions the drive shaft 4 in the separate state. The positioning portion 6 is formed on the tubular portion 111*b* of the contact case 111. The positioning portion 6 includes a second inclined portion 6*a*. The second inclined portion 6*a* is formed on a peripheral edge of the tubular portion 111*b* of the through hole 118 in the contact direction Z1 side. The second inclined portion 6*a* inclines in the separation direction Z2 side toward the axis Ax of the drive shaft 4. In the fourth variation, when the positioning portion 6 positions the drive shaft 4, the impact force generated in the axial direction can be reduced as compared with the case where the drive shaft 4 and the positioning portion 6 collide with each other in planes perpendicular to the drive shaft 4.

Figure 8:
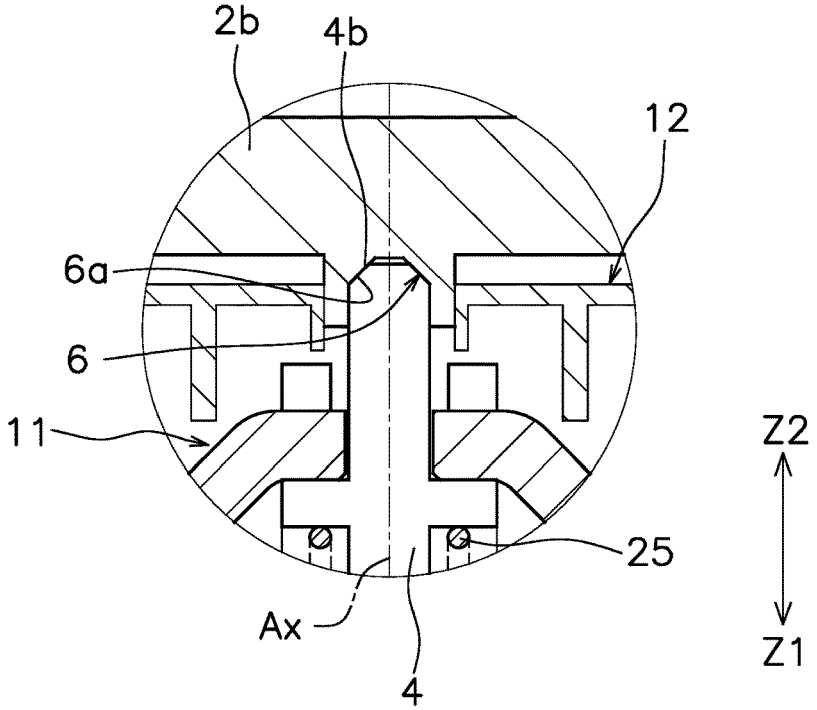
FIG. 8 is an enlarged cross-sectional view of a periphery of a drive shaft according to a fifth modification.

FIG. 8 is an enlarged cross-sectional view of a periphery of the drive shaft 4 according to a fifth modification. More specifically, it is an enlarged cross-sectional view of the periphery of the end portion of the drive shaft 4 in the separation direction Z2 side. In the fifth modification, the drive shaft 4 includes the first inclined portion 4*b* as in the fourth modification. The first inclined portion 4*b* is formed at an end portion of the drive shaft 4 in the separation direction Z2 side. The first inclined portion 4*b* inclines in the separation direction Z2 side toward the axis Ax of the drive shaft 4. The positioning portion 6 is disposed on the cover 2*b* to face the end portion of the drive shaft 4 in the separation direction Z2 side. The cover 2*b* is disposed in the separation direction Z2 side with respect to the drive shaft 4. The second inclined portion 6*a* of the positioning portion 6 inclines in the separation direction Z2 side toward the axis Ax of the drive shaft 4.

REFERENCE NUMERALS

2*b* cover (example of cover portion)
4 Drive shaft
4*b* First inclined portion
5 Electromagnetic drive device
6 Positioning portion
6*a* Second inclined portion
11 Contact case
11*b* Tubular portion
14*a* First fixed contact (example of fixed contact)
15*a* Second fixed contact (example of fixed contact)
16 Movable contact piece
16*a* First movable contact (example of movable contact)
16*b* Second movable contact (example of movable contact)
34 Movable iron core
34*a* First inclined portion
34*b* Curved surface portion
40 Housing member
100 Electromagnetic relay
Ax Axis of drive shaft
Z1 Contact direction (example of the first direction)
Z2 Separation direction (example of the second direction)

The invention claimed is:

1. An electromagnetic relay, comprising:

a fixed contact;

a movable contact piece including a movable contact disposed to face the fixed contact, the movable contact piece being movable in a first direction in which the movable contact piece comes into contact with the fixed contact and in a second direction in which the movable contact piece is separated from the fixed contact;

a drive shaft connected to the movable contact piece, the drive shaft being movable in the first direction and the second direction together with the movable contact piece;

a contact case configured to house the fixed contact and the movable contact, the contact case including a contact support portion and a tubular portion, the contact support portion configured to support the fixed contact, the tubular portion located closer to the drive shaft than the contact support portion;

an electromagnetic drive device including a movable iron core that is integrally movably connected to the drive shaft, the electromagnetic drive device being configured to switch between a contact state in which the movable contact comes into contact with the fixed contact and a separate state in which the movable contact is separated from the fixed contact by moving the drive shaft with the movable iron core; and a positioning portion configured to position the drive shaft or the movable iron core in the separate state, wherein the drive shaft or the movable iron core includes a first inclined portion that comes into contact with the positioning portion in the separate state, the first inclined portion being inclined with respect to the first direction or the second direction, the positioning portion comes into contact with only the first inclined portion of the drive shaft or the movable iron core in the separate state, a gap is defined between the tubular portion and the drive shaft, and the contact support portion and the tubular portion are disposed in the first direction relative to the movable contact.

2. The electromagnetic relay according to claim 1, wherein the first inclined portion is inclined in the first direction or the second direction toward an axis of the drive shaft.

3. The electromagnetic relay according to claim 1, wherein the first inclined portion includes a curved surface portion formed in a curved surface shape.

4. The electromagnetic relay according to claim 1, wherein the positioning portion includes a second inclined portion that comes into contact with the first inclined portion, and the first inclined portion and the second inclined portion are inclined in the first direction or the second direction toward an axis of the drive shaft.

5. The electromagnetic relay according to claim 1, wherein the tubular portion is disposed to face the movable iron core, the positioning portion is formed on the tubular portion, and the movable iron core includes the first inclined portion.

6. The electromagnetic relay according to claim 1, wherein the electromagnetic drive device includes a bottomed tubular housing member configured to house the movable iron core, the movable iron core includes the first inclined portion and is disposed to face the bottomed tubular housing member, and the positioning portion is formed on a bottom of the bottomed tubular housing member.

7. The electromagnetic relay according to claim 1, wherein the drive shaft includes the first inclined portion, the tubular portion is disposed to face the first inclined portion, and the positioning portion is formed on the tubular portion.

8. The electromagnetic relay according to claim 1, further comprising a cover portion disposed in the second direction with respect to the drive shaft, wherein the positioning portion is disposed on the cover portion to face one end of the drive shaft and the drive shaft includes the first inclined portion.

9. The electromagnetic relay according to claim 1, wherein the drive shaft includes the first inclined portion and a flat portion, the flat portion extending in a direction substantially orthogonal to the first direction or the second direction, the first inclined portion and the flat portion of the drive shaft are disposed on an end surface of the drive shaft in the opening direction, and the positioning portion comes into contact with only the first inclined portion of the drive shaft in the separate state without contacting the flat portion of the drive shaft in the separate state.

10. The electromagnetic relay according to claim 1, wherein the movable iron core includes the first inclined portion and a flat portion, the flat portion extending in a direction substantially orthogonal to the first direction or the second direction, the first inclined portion and the flat portion of the movable iron core are disposed on an end surface of the movable iron core in the opening direction, and the positioning portion comes into contact with only the first inclined portion of the movable iron core in the separate state without contacting the flat portion of the movable iron core in the separate state.

11. The electromagnetic relay according to claim 1, wherein the tubular portion connects a space in which the fixed contact and the movable contact are disposed to a space in which the drive device is disposed.

12. An electromagnetic relay, comprising:

a fixed contact;

a movable contact piece including a movable contact disposed to face the fixed contact, the movable contact piece being movable in a first direction in which the movable contact piece comes into contact with the fixed contact and in a second direction in which the movable contact piece is separated from the fixed contact;

a contact case configured to house the fixed contact and the movable contact;

a drive shaft connected to the movable contact piece, the drive shaft being movable in the first direction and the second direction together with the movable contact piece;

an electromagnetic drive device including a movable iron core that is integrally movably connected to the drive shaft, the electromagnetic drive device being configured to switch between a contact state in which the movable contact comes into contact with the fixed contact and a separate state in which the movable contact is separated from the fixed contact by moving the drive shaft with the movable iron core; and a positioning portion configured to position the drive shaft or the movable iron core in the separate state, the positioning portion being made of an insulating material, wherein the drive shaft or the movable iron core includes a first inclined portion that comes into contact with the positioning portion in the separate state, the first inclined portion being inclined with respect to the first direction or the second direction, the positioning portion comes into contact with only the first inclined portion of the drive shaft or the movable iron core in the separate state, and a gap is defined between the contact case and the drive shaft.

13. An electromagnetic relay, comprising:

a fixed contact;

a movable contact piece including a movable contact disposed to face the fixed contact, the movable contact piece being movable in a first direction in which the movable contact piece comes into contact with the fixed contact and in a second direction in which the movable contact piece is separated from the fixed contact;

a contact case configured to house the fixed contact and the movable contact;

a drive shaft connected to the movable contact piece, the drive shaft being movable in the first direction and the second direction together with the movable contact piece;

an electromagnetic drive device including a movable iron core that is integrally movably connected to the drive shaft, the electromagnetic drive device being configured to switch between a contact state in which the movable contact comes into contact with the fixed contact and a separate state in which the movable contact is separated from the fixed contact by moving the drive shaft with the movable iron core; and a positioning portion configured to position the drive shaft or the movable iron core in the separate state, wherein the drive shaft includes a first inclined portion and a flat portion, the first inclined portion coming into contact with the positioning portion in the separate state and being inclined with respect to the first direction or the second direction, the flat portion extending in a direction substantially orthogonal to the first direction or the second direction, the first inclined portion and the flat portion of the drive shaft are disposed on an end surface of the drive shaft in the opening direction, the positioning portion comes into contact with only the first inclined portion of the drive shaft in the separate state without contacting the flat portion of the drive shaft in the separate state, and a gap is defined between the contact case and the drive shaft.

* * * * *